US006381947B2

(12) United States Patent
Emmons

(10) Patent No.: US 6,381,947 B2
(45) Date of Patent: May 7, 2002

(54) FUEL INJECTION FOR A STAGED GAS TURBINE COMBUSTION CHAMBER

(75) Inventor: F. Richard Emmons, West Hartford, CT (US)

(73) Assignee: Rolls-Royce Deutschland Ltd & Co KG (DE)

( * ) Notice: Subject to any disclaimer, the term of this patent is extended or adjusted under 35 U.S.C. 154(b) by 0 days.

(21) Appl. No.: 09/851,947

(22) Filed: May 10, 2001

Related U.S. Application Data

(62) Division of application No. 09/194,160, filed as application No. PCT/EP97/02511 on May 5, 1997, now abandoned.

(30) Foreign Application Priority Data

May 23, 1996 (DE) ..... 196 20 874

(51) Int. Cl.[7] ..... F02C 9/00

(52) U.S. Cl. ..... 60/39.281; 60/734; 60/39.78; 60/39.81; 137/625.17

(58) Field of Search ..... 60/39.06, 734, 60/39.281, 747, 39.78, 39.79, 39.8, 39.81; 137/625.17, 624.15

(56) References Cited

U.S. PATENT DOCUMENTS

| | | | |
|---|---|---|---|
| 3,002,349 A | | 10/1961 | Arnett |
| 3,688,495 A | | 9/1972 | Fehler |
| 3,756,763 A | | 9/1973 | Elmore |
| 4,194,358 A | | 3/1980 | Stenger |
| 5,403,180 A | | 4/1995 | Chato |

FOREIGN PATENT DOCUMENTS

| | | |
|---|---|---|
| AU | 890295 | 4/1964 |
| DE | 1100377 | 2/1961 |
| DE | 4000446 A | 7/1991 |
| EP | 531072 A | 3/1993 |
| EP | 602942 A | 6/1994 |
| EP | 672862 A | 9/1995 |
| WO | 4329955 A | 3/1995 |
| WO | 95/11409 | 4/1995 |
| WO | 95/17632 | 6/1995 |

*Primary Examiner*—Charles G. Freay
*Assistant Examiner*—Ehud Gartenberg
(74) *Attorney, Agent, or Firm*—W. Warren Taltavull; Manelli Denison & Selter PLLC

(57) ABSTRACT

In a staged gas turbine combustion engine, each combustion chamber of an annular array of chambers includes at least a pilot and a main combustion stage each having an fuel injection nozzle; the method includes feeding fuel continuously in operation to the pilot stage nozzle and controlling the fuel flow to the main stage nozzle through a pulsing and dosing valve to control the fuel flow delivered to the main stage fuel nozzle.

3 Claims, 2 Drawing Sheets

FUEL INJECTION FOR A STAGED GAS TURBINE COMBUSTION CHAMBER

This application is a divisional of U.S. Ser. No. 09/194,160 filed Dec. 6, 1999, now abandoned which is a 371 of PCT/EP97/02511 filed May 5, 1992.

FIELD OF THE INVENTION

The invention relates to a method for fuel injection into a staged or steped gas turbine combustion chamber with separate fuel injection nozzles for each stage, whereby at least one stage is able to be switched off for specific operating conditions by interrupting the fuel supply. Furthermore, the invention relates to a fuel injection mechanism for execution of the fuel injection method according to the invention.

BACKGROUND OF THE INVENTION

For the state of the art, reference may be had to WO 95/17632 as an example.

Gas turbine combustion chambers, in particular annular combustion chambers of gas turbines, which operate with staged combustion/staged fuel injection, are increasingly gaining importance for the purpose of reducing the oxides of nitrogen. Typically, a pilot combustion chamber as well as a main combustion chamber is provided which each form constituting a so-called stage or step. Of course, further gradations/stages may also be provided in addition to these two stages. The pilot combustion chamber has as a first stage one or more pilot burners which, in the preferred case of application, comprises an annular combustion chamber and includes fuel injection nozzles in an annular arrangement; likewise, the second stage, namely the main combustion chamber, has several main burners also in the form of several injection nozzles preferably also in an annular arrangement, but optimized for reducing the oxides of nitrogen.

The attached FIG. 2 shows a basic illustration for such a staged gas turbine combustion chamber. In this case, the combustion chamber outer wall is marked with reference number 20 and the combustion chamber inner wall with reference number 21. In addition, these two walls 20, 21 are surrounded by enveloping walls 20*a*, 21*a* which also define on the left side the combustion chamber entrance 22*a* and on the right side the combustion chamber exit 22*b*. Typically, several sets of pilot and main combustion chambers such as are shown in FIG. 2 are arranged symmetrically about the center line or axis 23 in a gas turbine engine.

A separating wall structure 24 is provided within the left half of each combustion chamber. The so-called pilot combustion chamber 25*a* is situated between this separating wall structure 24 and the center line 23, while the so-called main combustion chamber 25*b* is below this separating wall structure 24, that is, radially outwardly of the pilot chamber 25*a*. Assigned to the pilot combustion chamber 25*a* are pilot nozzles 26*a*, while main nozzles 26*b* are provided for the main combustion chamber 25*b*. Fuel and/or an air-fuel mixture is introduced via these nozzles 26*a*, 26*b* into the combustion chambers, while a main air current 27 makes its way via the combustion chamber entrance 22*a* into the individual combustion chambers 25*a*, 25*b*. Furthermore, admixed air 28 can enter via openings in the outer wall 20, in the inner wall 21, as well as in the separating wall structure 24 into the individual combustion chambers 25*a*, 25*b*. The air-fuel mixture burned in the pilot burner combustion chamber 25*a* and/or in the main combustion chamber 25*b* as well as in the junction of these two combustion chambers is finally carried off via the combustion chamber exit 22*b*.

Only the pilot nozzles 26*a* are operated in lower stress points (low load operations) of the gas turbine, that is to say, the injection nozzles of the main burner 26*b* are not supplied with fuel. In higher load points of the gas turbine, the main burners 26*b* are operated in addition to the pilot burners 26*a*, in such a way that their injection nozzles are then supplied with fuel. Typically, the pilot combustion chamber 25*a*, which is also operated singly for starting the gas turbine and for raising the engine speed up to idle, is operated throughout the entire operating performance range of the gas turbine, particularly in an airplane gas turbine, in order to create an ignition source for the main burners 26*b* which are only switched on when necessary. The purpose of the staged combustion lies in the minimizing of harmful substance emissions, in particular $NO_x$. This is achieved in that the respective burner sizes can be better adapted to the given power requirement. Thus, to reduce $NO_x$ the combustion chamber temperature should be as low as possible, which can be achieved by targeted air supplying (admixed air 28) into the combustion chamber zone. In this connection, the respective stages, namely the pilot burner 26*a*/the main burners 26*b* are designed for special air-fuel ratios. In the case of low load points of the gas turbine, in which altogether only relatively little fuel is burned, the air-fuel ratio reaching the main burners 26*b* would be too great to be able to support a reasonable combustion at all. For this reason, the main burners 26*b* are switched on only in higher load conditions of the gas turbine.

FIG. 3 shows graphically the strategy according to which the individual burners, namely, the pilot burners 26*a* as well as the main burners 26*b*, are supplied with fuel in this connection. The total fuel flow for the two burners is plotted on the abscissa of this diagram, and the percentage of the pilot burners 26*a* and/or of the main burners 26*b* in this total fuel flow is plotted on the ordinate. The corresponding characteristic curve of the pilot burner 26*a* is marked with the letter A and that of the main burners 26*b* with the letter B. One recognizes that with only a slight total fuel flow at first, that is, in the left section of this diagram, only the pilot burners 26*a* are operated, in such a way that their share of the total fuel flow is 100%. As total fuel flow increases, the main burners 26*b* are then switched on, namely at the switch-on point Z. In so doing, however, there should not be a sudden power increase. Rather, a smooth power increase is desired, in such a way that with a relatively slight supply to the main burners 26*b*, the pilot burners 26*a* are supplied at the same time with a smaller fuel quantity. This switch-on point Z is therefore extremely critical with regard to its setting because there must always be a suitable air-fuel ratio in the pilot burners 26*a* as well as in the main burners 26*b*. In this regard, the same considerations also apply with respect to a reduction in or withdrawal of power of the gas turbine, that is, if the main burners 26*b* after being operated at first are switched off again. To avoid instabilities in the immediate surroundings of this switch-on point Z, a control that contains a hysteresis is proposed for this in WO 95/17632 mentioned above. As thrust increases, the main burners are switched on only at a higher total fuel throughput than when they are switched off as thrust decreases.

But since it is desirable to always have a defined fuel throughput in a defined load point or thrust status of the gas turbine, i.e., regardless of whether it is a matter of a thrust increase or a thrust reduction, the invention addresses the technical problem of providing another solution for the above-described problems in connection with the operation of a second stage with a first stage.

SUMMARY OF THE INVENTION

This technical problem is solved in that at least the stage which is able to be switched off can be operated with pulsed fuel injection. Appropriate fuel injection mechanisms for execution of this fuel injection method according to the invention are described in claims 5 and 6, while the further subclaims contain advantageous designs and further improvements.

The objectives of the invention are twofold: firstly, to pulse the fuel flow hence the combustion in the main combustion chamber and, secondly, to extend the operation region of the main burner stage further into the lean operating region. Pulsing the fuel flow is desirable since it is well known that pulsed combustion results in lower emissions of oxides of nitrogen.

According to the invention, at least the stage which is able to be switched off, i.e., preferably the above-mentioned main burner 25*b*, can be operated with pulsed fuel injection. This means that fuel injection is then not continuous but rather discontinuous. The fuel is thus introduced, practically clocked, into the combustion chamber, whereby the pulsation frequency may range from a few Hz to several 100 Hz. This pulsed injection results in a likewise pulsed combustion at least in theory. In this connection, a favorable air-fuel ratio can be set for each injection pulse or for each so-called combustion pulse. In this way, at least at low fuel quantities, fuel is no longer injected continuously but rather intermittently from then on. Thus, when favorable air-fuel ratios are set, overall, clearly less fuel can be injected than is possible with a conventional continuous injection. In particular, due to the pulsed injection the so-called switch-on point Z, can be reduced to a lower percentage of total fuel flow thus extending the operating region of the main burner stage to a lower power level. Thus, on one hand a smooth transition when switching on the second stage is attainable and, on the other hand, a defined fuel quantity is actually introduced into the combustion chamber for each operating point/thrust value, regardless of whether it is a matter of a thrust increase or a thrust reduction. The pulsation frequency, which should preferably be variable in order to be able to set a favorable combustion in a number of operating points, can preferably be above the characteristic frequencies of possible combustion chamber chugging, in such a way that no negative effects on combustion efficiency or on thrust or on noise generation need be feared. Rather, a combustion with a favorable efficiency can always be achieved, because there is a favorable air-fuel ratio for each combustion or injection pulse. Whereas, with the presently typical, continuous fuel injection into the main combustion chamber (able to be switched off), the minimum value of the fuel throughput is determined by the instability of the combustion due to too meager an air-fuel mixture. With the invention's pulsed fuel injection for each fuel pulse, a greater air-fuel ratio is achievable, in such a way that by targeted selection of the pulsation frequency, a stable combustion or a series of stable combustion pulses is still attainable even with clearly less total fuel supplied.

As already explained, the pulsation frequency of the discontinuous fuel injection can be varied, in order to be able to adapt the total fuel quantity injected within a certain period of time to the respective operating point of the gas turbine. But it is also desirable to be able to vary the fuel quantity able to be introduced with each injection pulse, whereby there are several possibilities for this. On the one hand, with a constant fuel quantity the injection period per unit of time can be altered, and on the other hand, with a constant injection period the fuel quantity introduced during this period can be altered. Of course, it is also possible to combine these two strategies, just as the pulsation frequency can additionally be adapted, in such a way that altogether, the optimal fuel injection in each case can be selected by means of the many variation possibilities for each operating point of the gas turbine. Thus, the fuel can be controlled by pulse width modulation. In this connection, it should be pointed out that in the high load operating conditions, one can switch from the pulsed injection to a continuous fuel injection, of course.

In addition, a further advantage of the pulsed fuel injection should be pointed out. Due to the targeted selection of the pulsation frequency, namely the typical combustion frequencies can be controlled in such a way that the so-called "combustion humming", which can occur with unstable combustion and with low fuel throughput and results from the characteristic frequencies of possible combustion chamber chugging, can be minimized. It should also be pointed out that the first stage or pilot combustion chamber, which is usually not switched off, can or should preferably operate with a continuous fuel injection, in particular also in order to ensure reliable ignition of the air-fuel mixture in the second stage or main combustion chamber.

An advantageous fuel injection mechanism for execution of such a pulsed fuel injection can comprise an electromagnetically and/or hydraulically actuated fuel injection valve the time of opening and open period of which can be adjusted in a targeted manner. Such fuel injection valves are known from reciprocating internal combustion engines. Appropriately modified, such fuel injection valves can then be used either to directly inject the fuel into the combustion chamber of a gas turbine or they can be connected upstream from an essentially typical fuel injection nozzle.

A fuel injection mechanism for execution of a pulsed fuel injection according to the invention can consist of a suitable pulsation control valve and a dosing valve that is arranged upstream from a basically typical fuel injection nozzle ending in the combustion chamber. In addition to the pulsation control valve, a dosing valve can be arranged upstream from this injection nozzle, whereby it is particularly advantageous to combine the pulsation control valve and the dosing valve in a component hereinafter designated a "pulse-doser".

DETAILED DESCRIPTION OF THE INVENTION

Figure 1:
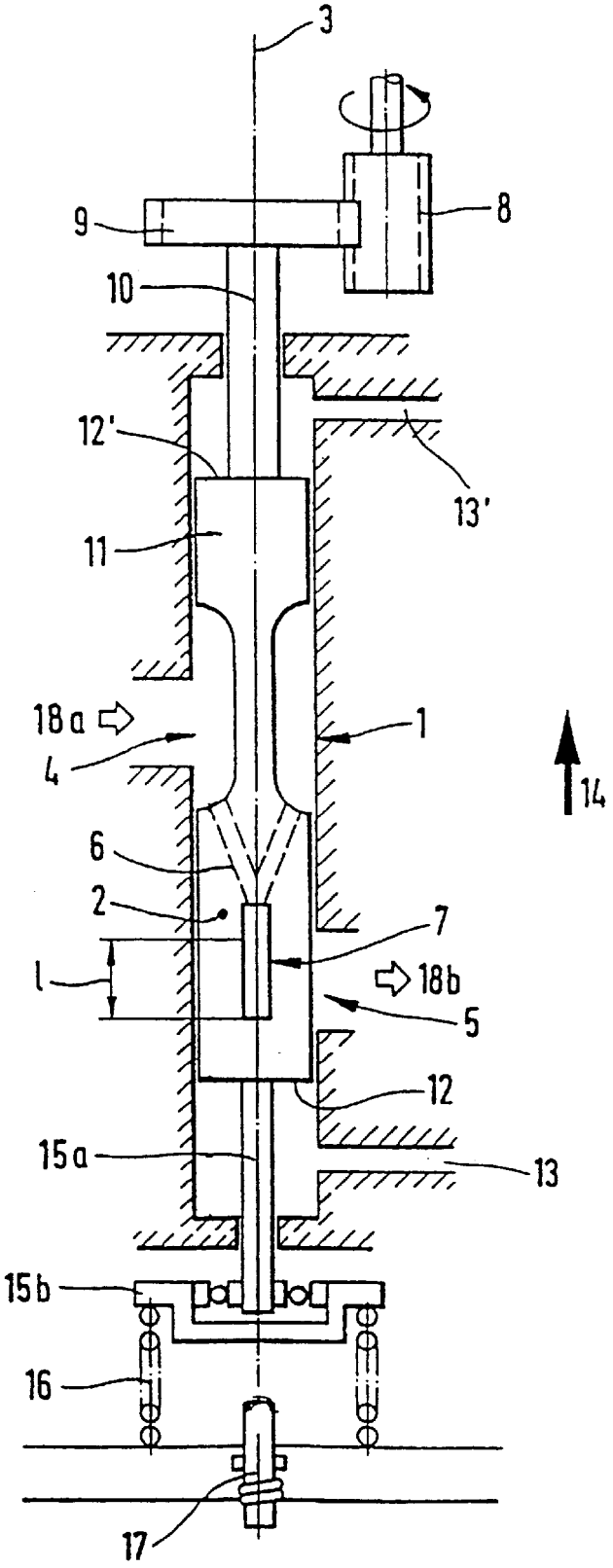
FIG. 1 shows A preferred example of execution for such a pulse-doser in a basic sectional diagram and is explained in greater detail below.
Figure 2:
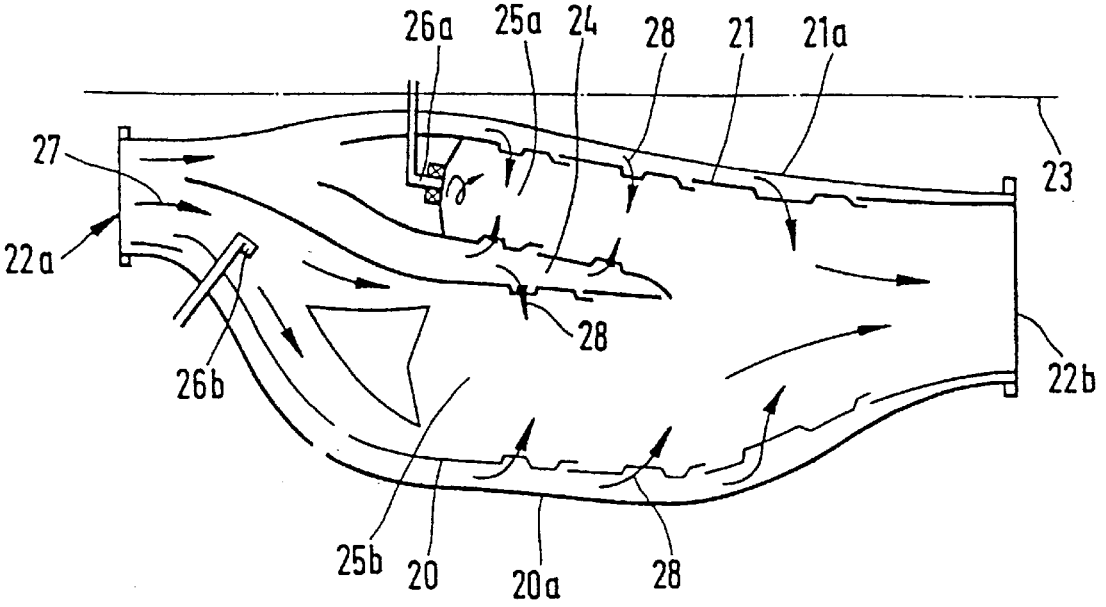
FIG. 2 is a sectional view of a staged gas turbine combustion chamber.
Figure 3:
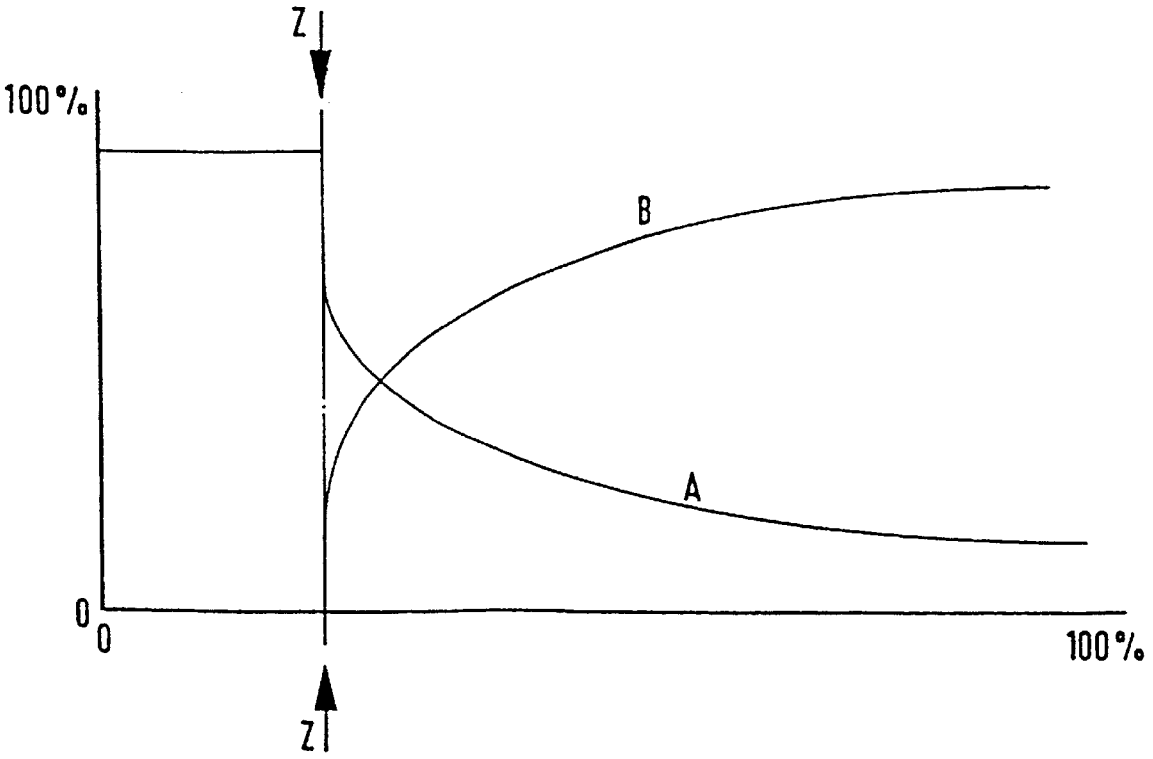
FIG. 3 is a graph of the fuel for the pilot burner and the main burner.

A cylinder of the described pulse-doser is marked with reference number 1. Inside it, a control valve 2 is arranged for rotation around the cylinder axis 3 and for sliding in the longitudinal direction of the cylinder axis 3. Fuel can be fed from a source having a pump via a cylinder wall opening 4 into the interior of the cylinder 1 according to the arrow 18*a* and fuel can be passed according to the arrow 18*b* out of the cylinder interior via another opening in the cylinder wall designated as a control window 5. The cylinder wall opening 4 is connected with the fuel supply system. The fuel (arrow 18*b*) carried off via the control window 5 is fed to the fuel injection nozzles of this combustion chamber stage which is able to be switched off.

The control valve 2 is designed hollow at least in sections, in such a way that there is an interior channel 6, illustrated only in dotted line, into which fuel that flowed in the direction of the arrow 18*a* via the wall opening 4 into the interior of the cylinder 1 can make its way, as can be seen, to a metering port 7. This valve interior channel 6, designed in the form of two bores in this case, is thereby connected with the fuel supply system of the gas turbine. On the outer wall of the control valve 2, the at least one metering port 7 is provided which is connected with the valve interior channel 6, that is, with the corresponding bores. Fuel that is introduced via the wall opening 4 can thereby finally exit via the metering port 7.

The already described control window 5 is situated in the wall of the cylinder 1 roughly at the level of the metering port 7. If the control valve 2 is then continuously rotated around the cylinder axis 3, fuel that was introduced via the wall opening 4 is carried off in pulsed manner via the control window 5. Whenever the metering port 7 becomes congruent with the control window 5 when the control valve 2 rotates, a quantity of fuel can exit according to the arrow 18*b* through the control window 5 and finally make its way to the fuel injection nozzle of the combustion chamber stage. As soon as the rotating metering port 7 has passed the control window 5, however, this fuel flow is interrupted again. Solely due to the rotation of the control valve 2 in the cylinder 1, a pulsed fuel injection into a gas turbine combustion chamber stage is thereby attainable. In this connection, the pulsation frequency is predetermined by the rotating speed of the control valve 2 in the cylinder 1, in such a way that with targeted selection of the rotating speed, a specific pulsation frequency can be set.

The quantity of the fuel carried off via the control window 5 can also be influenced by the rotation frequency of the control valve 2 and hence the metering port 7. However, if a certain rotation frequency is desired in consideration of certain marginal conditions, a preferred setting of the fuel quantity delivered per fuel pulse is possible by displacing the control valve 2 along the cylinder axis 3 in the direction of the arrow 14. In this way, the effective length l of the metering port 7, which becomes congruent with the control window 5, can be changed. When the value of the length l is greater, a greater quantity of fuel is carried off via the control window 5, and when the length l is smaller, a smaller quantity of fuel is carried off.

The control valve 2 can be made to rotate around the cylinder axis 3 by the gearbox of the gas turbine but also by an electric motor, of which only the output gear 8 is shown, with which a gearwheel meshes which is connected via an axle stub 10 with a so-called guide extension 11 of the control valve 2. This guide extension 11 is also guided inside the cylinder 1 and has a face 12' on which a hydraulic medium, which makes its way above this guide extension 11 via a control opening 13' into the interior of the cylinder 1, acts with constant pressure. A comparable control opening 13 is situated below the control valve 2 in the cylinder 1, in such a way that a hydraulic medium can also act on this lower face 12 resulting in a force balance against spring 16. If the hydraulic pressure in the control opening 13 is then increased in relation to that in the control opening 13', the control valve 2 is displaced upward in the direction of the arrow 14. A lowering of the pressure in the control opening 13 in relation to that in the control opening 13', on the other hand, causes a displacement of the control valve downward against the direction of the arrow 14. This described displacement in or against the direction of the arrow 14 can be carried out by the gearwheel 9 with respect to the output gear 8, because the latter is designed clearly wider than the gearwheel 9.

Also provided on the spring element 16 is an adjusting rod 15*a* and via a spring plate 15*b*, whereby an adjusting screw 17 is additionally provided that can also act on the spring plate 15*b*, in such a way that a maximum fuel throughput via the metering port 7 and the control window 5 can be set. Nevertheless, this and numerous other details, in particular construction details, may be designed quite differently from this example of execution shown, without departing from the content of the patent claims. Rather, what is essential is that generally speaking, at least the stage able to be switched off—of a staged gas turbine combustion chamber can be operated with pulsed fuel injection.

What is claimed is:

1. Fuel injection apparatus for execution of a pulsed fuel injection into a combustion chamber wherein connected upstream from a fuel injection nozzle of the combustion chamber is a fuel dosing valve, said apparatus including a pulsation control valve with said fuel dosing valve being combined as one fuel delivery component, said one fuel delivery component having a single control valve element mounted for rotation in a cylinder and being slidable in the direction of the cylinder axis, said valve element having a metering port in communication with a valve passage and which is connectable with a fuel supply system for the combustion chamber, said cylinder having a control window, said valve element port being able to be brought to overlap said control window in the cylinder which is also connected with the fuel supply system, said control valve element having faces and being actively controlled to be positioned along the cylinder axis by hydraulic pressure acting on at least one of said faces.

2. Fuel injection apparatus according to claim 1, wherein said control valve element is made to rotate by an electric motor.

3. The invention as claimed in claim 1 wherein said control valve element is made to rotate by a gear connection from a power source.

* * * * *